US005747206A

United States Patent [19]

Agata et al.

[11] Patent Number: 5,747,206

[45] Date of Patent: May 5, 1998

[54] ELECTROPHOTOGRAPHIC PHOTORECEPTOR

[75] Inventors: Takeshi Agata; Akira Imai; Yasuo Yamamoto; Yutaka Sugizaki; Katsuhiro Sato, all of Minami Ashigara, Japan

[73] Assignee: Fuji Xerox Co., Ltd., Tokyo, Japan

[21] Appl. No.: 698,006

[22] Filed: Aug. 13, 1996

[30] Foreign Application Priority Data

| | | | |
|---|---|---|---|
| Aug. 15, 1995 | [JP] | Japan | 7-228618 |
| Dec. 25, 1995 | [JP] | Japan | 7-336410 |

[51] Int. Cl.[6] ..... G03G 15/04

[52] U.S. Cl. ..... 430/64; 430/60; 430/58

[58] Field of Search ..... 430/60, 64, 58

[56] References Cited

U.S. PATENT DOCUMENTS

| | | | |
|---|---|---|---|
| 4,063,947 | 12/1977 | Pochan et al. | 430/58 |
| 4,471,039 | 9/1984 | Borsenberger et al. | 430/58 |
| 5,154,996 | 10/1992 | Makino et al. | 430/58 |
| 5,286,591 | 2/1994 | Hongo | 430/60 |
| 5,464,717 | 11/1995 | Sakaguchi et al. | 430/58 |

FOREIGN PATENT DOCUMENTS

| | | |
|---|---|---|
| A-48-47344 | 7/1973 | Japan . |
| 52-020836 | 2/1977 | Japan . |
| 52-20836 | 2/1977 | Japan . |
| 55-142356 | 11/1980 | Japan . |
| A-55-142356 | 11/1980 | Japan . |
| A-58-30757 | 2/1983 | Japan . |
| A-59-170846 | 9/1984 | Japan . |
| A-60-227264 | 1/1985 | Japan . |
| A-60-225856 | 11/1985 | Japan . |
| A-62-264063 | 11/1987 | Japan . |
| A-2-230160 | 9/1990 | Japan . |
| A-5-194523 | 8/1993 | Japan . |

*Primary Examiner*—George F. Lesmes
*Assistant Examiner*—Cheryl Juska
*Attorney, Agent, or Firm*—Oliff & Berridge, PLC

[57] ABSTRACT

An electrophotographic photoreceptor comprising a conductive substrate having thereon an undercoat layer and a photoconductive layer, the undercoat layer comprising a specific polymer compound which is prepared by using at least one of monomers represented by formula (1):

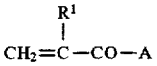

(1)

wherein $R^1$ represents a hydrogen atom or a methyl group; and A represents a group represented by formula (2), (3), (4), (5) or (6):

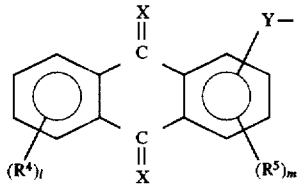

(2)

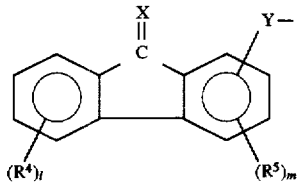

(3)

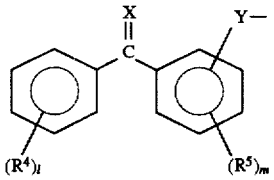

(4)

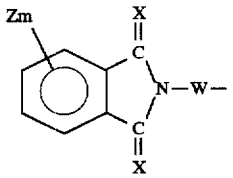

(5)

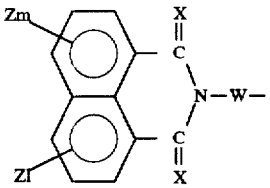

(6)

where the symbols in the above formulae are defined in the specification.

7 Claims, No Drawings

ELECTROPHOTOGRAPHIC PHOTORECEPTOR

FIELD OF THE INVENTION

The present invention relates to an electrophotographic photoreceptor having an undercoat layer containing a specific polymer compound.

BACKGROUND OF THE INVENTION

Of conventional photoreceptors for electrophotography, particularly for use in electrophotographic copiers, printers and facsimiles, those having a photoconductive layer formed directly on an electrically conductive substrate have reduced chargeability and lack potential stability against repeated use. Further, in this type of photoreceptors, the photoconductive layer tends to separate for lack of adhesion to the conductive substrate, or coating defects tend to develop on formation of the photoconductive layer on the conductive substrate. Furthermore, if there is unevenness on the surface of the conductive substrate, the photoconductive layer formed thereon will have a non-uniform thickness, resulting in development of image defects, such as so-called black dots or white blanks.

These problems have been solved by providing an undercoat layer between an electrically conductive substrate and a photoconductive layer. The undercoat layer is basically required to perform such functions as (1) to prevent charge injection from the conductive substrate while unexposed; (2) to release the charges in the photoreceptor to the conductive substrate upon exposure; (3) not to accumulate charges and not to undergo change in electrical characteristics during continuous use; (4) to counteract the influence of the surface unevenness of the conductive substrate; and (5) to have adhesion to the conductive substrate and have uniform and firm adhesion to the layer formed thereon, e.g., a photoconductive layer.

Materials conventionally proposed for the undercoat layer include thermoplastic resins such as polyvinyl acetate, polyvinyl alcohol, polyvinyl formal, polyvinyl butyral, polyester and polyamide, and thermosetting resins such as epoxy resins, melamine resins, urethane resins and phenolic resins (see JP-A-48-47344, JP-A-52-20836, JP-A-58-30757, JP-A-60-225856, JP-A-60-227264, etc.; the term "JP-A" as used herein means an "unexamined published Japanese patent application"). However, an undercoat layer mainly comprising these resins and having a sufficient thickness enough to bring about substantial improvements on chargeability or against image defects is liable to cause an increase in residual potential of the photoreceptor. Moreover, in most of the undercoat layers formed of these materials, since the migration of charges within the layer depends chiefly on ion conduction, the charge migration is susceptible to changes of humidity in the atmosphere. The reduction in photosensitivity and the increase in residual potential are particularly conspicuous in a low-temperature and low-humidity environment.

To avoid these problems, an undercoat layer comprising a polymer containing a low-molecular weight electron-transporting substance or electron-accepting substance has been proposed (see JP-A-55-142356 and JP-A-59-170846). Of the proposed low-molecular weight compounds, those easily soluble in organic solvents tend to ooze out of the layer when a photoconductive layer is applied on the undercoat layer and migrates into the photoconductive layer, resulting in a shortage of concentration in the undercoat layer; and those slightly soluble in organic solvents tend to crystalize in the undercoat layer, failing to produce the desired improving effects.

SUMMARY OF THE INVENTION

An object of the present invention is to provide an electrophotographic photoreceptor having improved characteristics in terms of chargeability, photosensitivity, and stability against repeated use.

Other objects and effects of the invention will be apparent from the following description.

In order to accomplish the above objects, the inventors of the present invention have extensively studied. As a result, the inventors found that an excellent electrophotographic photoreceptor can be obtained by providing an undercoat layer containing a specific polymer compound.

Therefore, the above objects of the present invention have been achieved by providing an electrophotographic photoreceptor comprising an electrically conductive substrate having thereon an undercoat layer and a photoconductive layer, wherein the undercoat layer contains at least one polymer compound prepared by using at least one of monomers represented by formula (1):

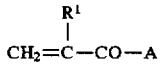

(1)

wherein $R^1$ represents a hydrogen atom or a methyl group; and A represents a group represented by formula (2), (3), (4), (5) or (6):

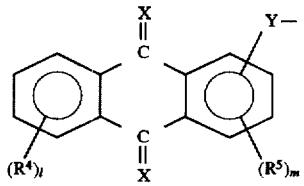

(2)

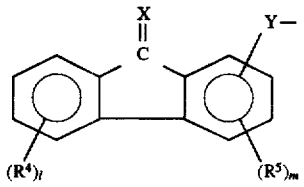

(3)

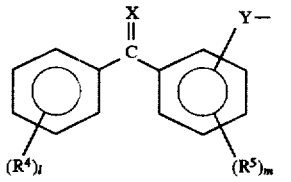

(4)

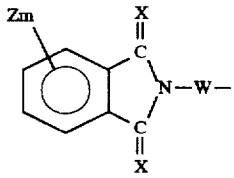

(5)

-continued

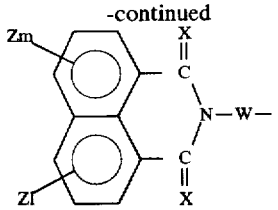

(6)

wherein X represents an oxygen atom, $C(CN)_2$, $C(CN)COOR^2$ or $C(COOR^2)(COOR^3)$; Y represents an oxygen atom or $—COO(CH_2)_nO—$; $R^2$ and $R^3$ each represents an alkyl group or an aryl group; $R^4$ and $R^5$ each represents an alkyl group, an aryl group, a halogen atom, a nitro group, an acyl group or a cyano group; W represents $—(CH_2)_nO—$ or $—Ar—(R)_k—COO(CH_2)_nO—$ (wherein Ar represents an arylene group; R represents an alkylene group; and k represents 0 or 1); Z represents an alkyl group, an aryl group, a halogen atom, a nitro group, an acyl group or a cyano group; n represents an integer of from 1 to 20; and m and l each represents an integer of from 0 to 2.

The above described polymer compound for use in the present invention has electron transporting properties. When used as a constituent material of the undercoat layer of an electrophotographic photoreceptor, the compound transports only negative charges selectively while it blocks injection of positive charges from the photoconductive layer to the conductive substrate. Therefore, the undercoat layer comprising the polymer compound of the invention provides high chargeability, high photosensitivity, and low residual potential without suffering the influence of change in humidity of the atmosphere.

DETAILED DESCRIPTION OF THE INVENTION

The polymer compound for use in the undercoat layer of the electrophotographic photoreceptor of the present invention is synthesized wholly or mainly from at least one of monomers represented by formula (1) (The polymer compound is hereinafter referred to as polymer A).

The monomer represented by formula (1) can be synthesized by, for example, (i) reacting a compound represented by formula (2a), (3a), (4a), (5a) or (6a) shown below with a (meth)acrylic acid chloride represented by formula (7) shown below in the presence of a base, or by (ii) reacting a carboxylic acid chloride represented by formula (2b), (3b), (4b), (5b) or (6b) shown below and a hydroxyalkyl (meth) acrylate represented by formula (8) shown below in the presence of a base:

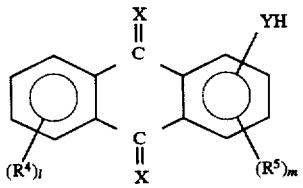

(2a)

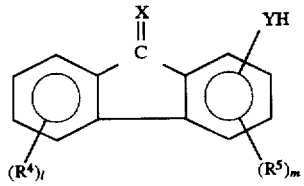

(3a)

-continued

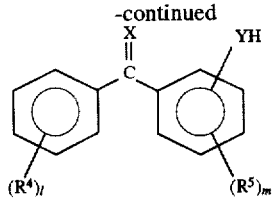

(4a)

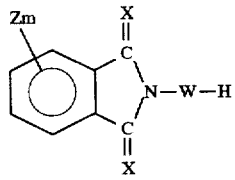

(5a)

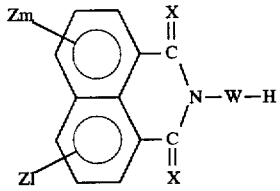

(6a)

wherein X represents an oxygen atom, $C(CN)_2$, $C(CN)COOR^2$ or $C(COOR^2)(COOR^3)$; Y represents an oxygen atom or $—COO(CH_2)_nO—$; $R^2$ and $R^3$ each represents an alkyl group or an aryl group; $R^4$ and $R^5$ each represents an alkyl group, an aryl group, a halogen atom, a nitro group, an acyl group or a cyano group; W represents $—(CH_2)_nO—$ or $—Ar—(R)_k—COO(CH_2)_nO—$ (wherein Ar represents an arylene group; R represents an alkylene group; and k represents 0 or 1); Z represents an alkyl group, an aryl group, a halogen atom, a nitro group, an acyl group or a cyano group; n represents an integer of from 1 to 20; and m and l each represents an integer of from 0 to 2;

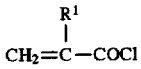

(7)

wherein $R^1$ represents a hydrogen atom or a methyl group;

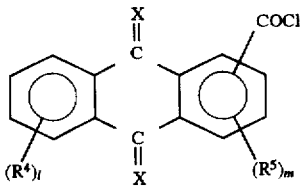

(2b)

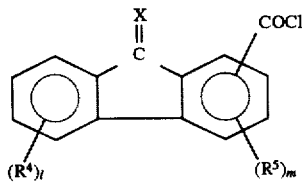

(3b)

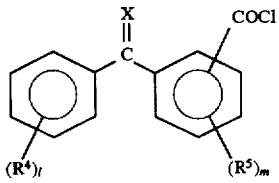

(4b)

-continued (5b)

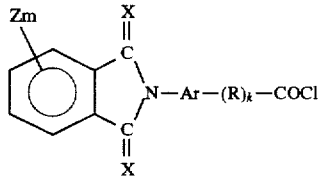

(6b)

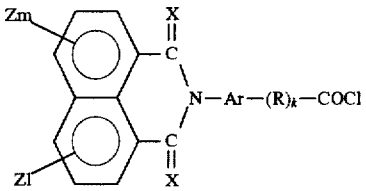

wherein X, Z, Ar, R, $R^4$, $R^5$, k, l and m are as defined above;

(8)

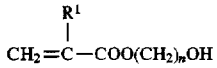

wherein $R^1$ represents a hydrogen atom or a methyl group, and n represents an integer of from 1 to 20.

In the above formulae (2) to (6), (2a) to (6a) and (2b) to (6b), $R^2$, $R^3$, $R^4$ and $R^5$ each is preferably an alkyl group having from 1 to 10 carbon atoms or an aryl group selected from phenyl, benzyl and tolyl; Ar is preferably phenyl, naphthyl or xylyl; R present in W is preferably has from 1 to 20 carbon atoms; and Z is preferably an alkyl group having from 1 to 10 carbon atoms or an aryl group selected from phenyl, benzyl and tolyl.

Specific examples of the monomer represented by formula (1) are shown in Tables 1 to 5 below, but not limited to these compounds. In the columns headed by each of $R^4$, $R^5$ and Z in the following tables 1 to 5, "-" represents that l, m and n is 0, respectively.

TABLE 1

(2)

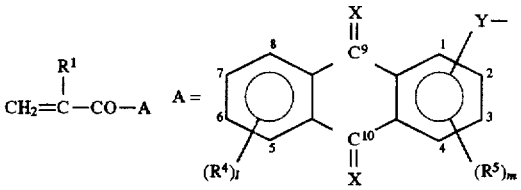

| No. | X | Y | $R^1$ | $R^4$ | $R^5$ |
|---|---|---|---|---|---|
| 1 | O | 2-$COO(CH_2)_2O$— | $CH_3$ | — | — |
| 2 | O | 2-$COO(CH_2)_2O$— | H | — | — |
| 3 | O | 1-O— | $CH_3$ | 8-$COCH_3$ | — |
| 4 | O | 1-O— | H | — | — |
| 5 | O | 2-$COO(CH_2)_2O$— | $CH_3$ | 7-$NO_2$ | — |
| 6 | O | 2-$COO(CH_2)_2O$— | H | 7-Cl | — |
| 7 | $C(CN)_2$ | 2-$COO(CH_2)_2O$— | $CH_3$ | 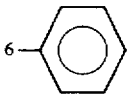 | — |
| 8 | $C(CN)_2$ | 2-$COO(CH_2)_6O$— | H | 5-$NO_2$, 7-$NO_2$ | — |
| 9 | $C(CN)_2$ | 2-O— | H | 7-CN | — |
| 10 | $C(CN)(COOCH_3)$ | 1-O— | H | 7-$NO_2$ | — |
| 11 | $C(COOCH_3)_2$ | 1-O— | H | — | — |
| 12 | $C(COOCH_2CH_3)_2$ | 2-$COO(CH_2)_{10}O$— | H | 7-Cl | — |

TABLE 2

(3)

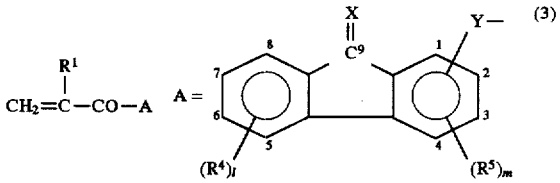

| No. | X | Y | $R^1$ | $R^4$ | $R^5$ |
|---|---|---|---|---|---|
| 13 | O | 4-$COO(CH_2)_2O$— | $CH_3$ | — | — |
| 14 | O | 4-$COO(CH_2)_2O$— | H | — | — |
| 15 | O | 2-O— | $CH_3$ | — | — |
| 16 | O | 4-O— | H | — | — |
| 17 | O | 4-$COO(CH_2)_6O$— | $CH_3$ | 7-$NO_2$ | 2-$NO_2$ |
| 18 | O | 2-$COO(CH_2)_6O$— | H | 7-Cl | 2-Cl |
| 19 | $C(CN)_2$ | 4-$COO(CH_2)_2O$— | $CH_3$ | — | — |
| 20 | $C(CN)_2$ | 2-$COO(CH_2)_{16}O$— | H | 5-$NO_2$,7-$NO_2$ | — |
| 21 | $C(CN)_2$ | 2-O— | H | — | 4-CN |
| 22 | $C(CN)(COOCH_3)$ | 2-O— | H | 7-$NO_2$ | 2-$NO_2$ |

TABLE 2-continued

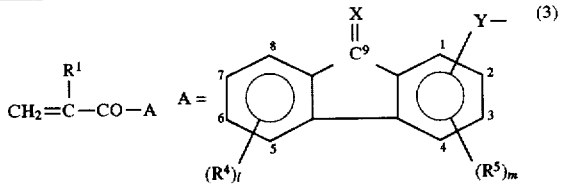

(3)

| No. | X | Y | $R^1$ | $R^4$ | $R^5$ |
|---|---|---|---|---|---|
| 23 | $C(COOCH_3)_2$ | 4-O— | H | 5-$COCH_3$ | — |
| 24 | $C(COOCH_2CH_3)_2$ | 2-$COO(CH_2)_8O$— | H | 7-Cl | 2-Cl |

TABLE 3

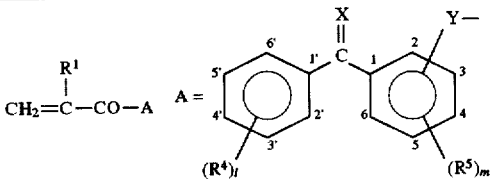

(4)

| No. | X | Y | $R^1$ | $R^4$ | $R^5$ |
|---|---|---|---|---|---|
| 25 | O | 4-$COO(CH_2)_2O$— | $CH_3$ | — | — |
| 26 | O | 2-$COO(CH_2)_2O$— | H | — | — |
| 27 | O | 3-O— | $CH_3$ | — | — |
| 28 | O | 4-O— | H | 4'-Cl | — |
| 29 | O | 4-$COO(CH_2)_2O$— | $CH_3$ | 4'-$NO_2$ | — |
| 30 | O | 2-$COO(CH_2)_2O$— | H | 4'— 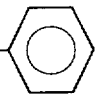 | — |
| 31 | $C(CN)_2$ | 4-$COO(CH_2)_2O$— | $CH_3$ | — | — |
| 32 | $C(CN)_2$ | 2-$COO(CH_2)_6O$— | H | 4'-$NO_2$ | — |
| 33 | $C(CN)_2$ | 2-O— | $CH_3$ | 4'-$NO_2$ | 4-CN |
| 34 | $C(CN)(COOCH_3)$ | 2-O— | H | 4'-$NO_2$ | — |
| 35 | $C(COOCH_3)_2$ | 4-O— | $CH_3$ | — | — |
| 36 | $C(COOCH_2CH_3)_2$ | 2-$COO(CH_2)_8O$— | H | 4'-$NO_2$ | 4-Cl |

TABLE 4

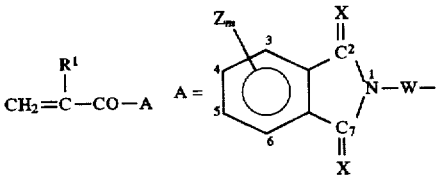

(5)

| No. | X | W | Z | $R^1$ |
|---|---|---|---|---|
| 37 | O | —$(CH_2)_2O$— | — | H |
| 38 | O | —$(CH_2)_2O$— | — | $CH_3$ |
| 39 | O | —$(CH_2)_3O$— | — | $CH_3$ |
| 40 | O | —$(CH_2)_6O$— | — | H |
| 41 | O | —$(CH_2)_{10}O$— | 4-$CH_3$ | $CH_3$ |
| 42 | O | 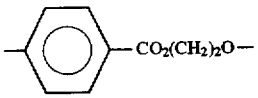 —$CO_2(CH_2)_2O$— | — | $CH_3$ |
| 43 | O | 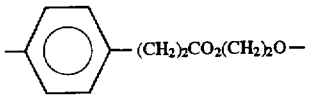 —$(CH_2)_2CO_2(CH_2)_2O$— | 4-Cl | H |

TABLE 4-continued

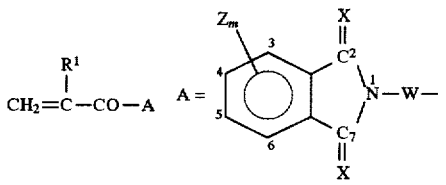

(5)

| No. | X | W | Z | $R^1$ |
|---|---|---|---|---|
| 44 | O | $-(CH_2)_6O-$ | $4\text{-}NO_2$ | $CH_3$ |
| 45 | $C(CN)_2$ | $-(CH_2)_6O-$ | 4-F, 5-F | $CH_3$ |
| 46 | $C(CN)_2$ | $-(CH_2)_3O-$ | 4-Br | $CH_3$ |
| 47 | $C(CN)(CO_2CH_3)$ | $-(CH_2)_2O-$ | — | H |
| 48 | $C(CO_2CH_2CH_3)_2$ | $-(CH_2)_3O-$ | — | $CH_3$ |

TABLE 5

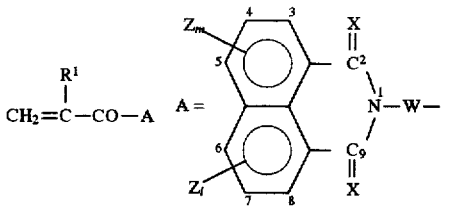

(6)

| No. | X | W | Z | $R^1$ |
|---|---|---|---|---|
| 49 | O | $-(CH_2)_2O-$ | — | H |
| 50 | O | $-(CH_2)_2O-$ | — | $CH_3$ |
| 51 | O | $-(CH_2)_3O-$ | — | $CH_3$ |
| 52 | O | $-(CH_2)_4O-$ | 4-Br | H |
| 53 | O | $-(CH_2)_6O-$ | $4\text{-}NO_2$ | $CH_3$ |
| 54 | O | $-(CH_2)_{10}O-$ | 4-Cl | H |
| 55 | O | $-(CH_2)_3O-$ | $3\text{-}NO_2$, $6\text{-}NO_2$ | $CH_3$ |
| 56 | O | 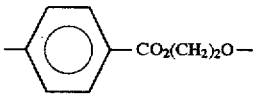 | — | $CH_3$ |
| 57 | $C(CN)_2$ | $-(CH_2)_3O-$ | — | $CH_3$ |
| 58 | $C(CN)_2$ | $-(CH_2)_6O-$ | $3\text{-}NO_2$, $6\text{-}NO_2$ | H |
| 59 | $C(CN)(CO_2CH_3)$ | $-(CH_2)_3O-$ | $4\text{-}NO_2$ | $CH_3$ |
| 60 | $C(CO_2CH_3)_2$ | $-(CH_2)_4O-$ | — | $CH_3$ |

Examples of Polymer A include homopolymers obtained by homopolymerizing a monomer represented by formula (1) and copolymers obtained by copolymerizing two or more kinds of monomers represented by formula (1) or by copolymerizing monomer(s) represented by formula (1) and other common polymerizable olefin monomer(s). Examples of the polymerizable olefin monomer include acrylic acid derivatives such as ethyl acrylate, methyl methacrylate, 2-hydroxyethyl methacrylate and glycidyl methacrylate; acryloxysilanes such as methacryloxypropyltrimethoxysilane; and various vinyl compounds such as acrylonitrile, styrene, vinyl chloride, vinyl acetate and 1,3-butadiene. The polymer A generally contains the monomer represented by formula (1) in an amount of not less than 1% by weight, preferably not less than 20% by weight, particularly preferably not less than 50% by weight based on the total weight thereof.

Polymer A can be prepared by a known polymerization method including anion polymerization, cation polymerization and radical polymerization, but radical polymerization methods are preferred in the present invention for their simplicity.

The undercoat layer may comprise one kind of polymer A alone or two or more kinds of polymers A in combination. Alternatively, the undercoat layer may further comprises other commonly used polymer material(s). Examples of the above described other polymer materials which can be used in combination include, in addition to various polyacrylic ester derivatives, thermoplastic resins such as polyvinyl acetate, polyvinyl alcohol, polyvinyl formal, polyvinyl butyral, polyester, polycarbonate and polyamide; and thermosetting resins such as epoxy resins, melamine resins and urethane resins.

The content of polymer A in the undercoat layer for use in the present invention is preferably from 70 to 99% by weight of the layer.

The content of the other polymer which can be used in combination with polymer A in the undercoat layer is generally from 0 to 99% by weight, preferably not more than 30% by weight based on the weight of the layer.

For further improving the electrical characteristics of the photoreceptor, the undercoat layer may further contain an arbitrary organic low-molecular weight compound in addition to polymer A. The term "organic low-molecular weight compound" as used herein means a low-molecular weight electron-accepting compound, a low-molecular weight electron-donating compound, a low-molecular weight organic metal compound, or the like, which functions to enhance or control the electron conductivity independently of polymer A or in cooperation with polymer A, for example, through formation of a charge transporting complex.

Examples of the electron-accepting compound for use in the invention include aromatic nitro compounds such as 4-nitrobenzaldehyde; cyclic carboxylic acid anhydrides such as maleic anhydride; aromatic carboxylic acid imides such as N-(n-butyl)-1,8-naphthalimide; quinones such as p-chloranil and 2,3-dichloroanthraquinone; tetracyanoquinodimethane derivatives such as tetracyanoquinoanthraquinodimethane; and fluorenone derivatives such as n-octyl 9-dicyanomethylenefluorene-4-carboxylate.

Examples of the electron-donating compound for use in the invention include oxadiazoles such as 2,5-bis(4-dimethylaminophenyl)-1,3,4-oxadiazole; styryl compounds such as 9-(4-diethylaminostyryl)anthracene; carbazole compounds such as N-methyl-N-phenylhydrazone-3-methylidene-9-ethylcarbazole; pyrazoline compounds such as 1-phenyl-3-(p-dimethylaminostyryl)-5-(p-dimethylaminophenyl)pyrazoline; triphenylamine compounds such as N,N'-diphenyl-N,N'-bis(3-methylphenyl) benzidine and tri(4-methylphenyl)amine; tetrathiafulvalene; and N,N,N'N'-tetraethylphenylene-diamine.

Examples of the organic metal compound include chelate complexes such as acetylacetone complexes, acetoacetate complexes and oxyquinoline complexes of a transition metal element or group III or VI metallic element, etc.; and cyclopentadienyl complexes of these metallic elements such as ferrocenes.

These organic low-molecular weight compounds may be used either alone or as a combination of two or more thereof. The amount of the organic low-molecular weight compound to be added is selected arbitrarily from the range 1 to 30% by weight based on the total weight of components constituting the undercoat layer.

If desired, the undercoat layer may be subjected to a hardening treatment so as to have improved mechanical strength, improved adhesion to the conductive substrate, or improved resistance against a solvent used in forming a photoconductive layer thereon. The hardening treatment can be achieved by, for example, (i) a method comprising mixing polymer A with a thermosetting resin (such as an epoxy resin, a phenolic resin or a melamine resin) or a coupling agent (such as a silane coupling agent, a zirconium coupling agent or a titanate coupling agent), and applying the mixture to a conductive substrate followed by heating to cure; or (ii) a method comprising using, as polymer A, a polymer prepared from the monomer of formula (1) and a reactive residue-containing comonomer such as 2-hydroxyethyl methacrylate, glycidyl methacrylate or methacryloxypropyltrimethoxysilane, and causing the polymer A applied on a conductive substrate to crosslink or cure by heating, irradiating or any other appropriate chemical treatments.

The undercoat layer is formed by dissolving the above-described materials in an organic solvent, applying the solution onto a conductive substrate by, for example, dip coating, and drying the coating upon application of heat. Examples of suitable organic solvent include alcohols (e.g., 2-propanol and 1-butanol); ketones (e.g., methyl ethyl ketone and cyclohexanone); halogen-containing solvents (e.g., dichloromethane and 1,1,2,2-tetrachloroethane); aromatic solvents (e.g., chlorobenzene and m-cresol); and amides (e.g., N,N-dimethylacetamide and N-methylpyrrolidone). The drying under heat is carried out at generally from 50° to 200° C. The thickness of the undercoat layer can be arbitrarily selected from the range of from 0.1 to 10 μm. Particularly preferred thickness of the undercoat layer is from 0.5 to 5 μm.

The photoconductive layer may have a single layer structure containing both a charge generating material and a charge transporting material, or a laminate structure composed of a charge generating layer containing a charge generating material and a charge transporting layer containing a charge transporting material. The present invention produces marked improving effects when applied to the laminate type. If desired, a surface layer may be provided on the photoconductive layer.

The charge generating layer of the laminate type photoconductive layer is generally formed by dispersing a charge generating material and an appropriate binder in an organic solvent, applying the dispersion on the undercoat layer by, for example, dip coating, and drying; or by vacuum evaporation.

Examples of the charge generating material for use in the charge generating layer include phthalocyanine pigments, various azo pigments, perylene pigments, condensed ring aromatic pigments such as dibromoanthanthrone and squarylium pigments. In particular, the invention produces marked improving effects when in using phthalocyanine pigments such as metal-free phthalocyanine, chlorogallium phthalocyanine, hydroxygallium phthalocyanine, dichlorotin phthalocyanine and titanyl phthalocyanine. Examples of the binder include polyvinyl formal, polyvinyl butyral, polyvinyl alcohol, polyester, polycarbonate and polymethyl methacrylate.

The content of the charge generating material is generally from 1 to 99% by weight, preferably from 10 to 90% by weight based on the weight of the charge generating layer.

The thickness of the charge generating layer can be arbitrarily selected from the range of from 0.1 to 5 μm. Particularly preferred thickness thereof is from 0.1 to 1.5 μm.

The charge transporting layer of the laminate type photoconductive layer is formed by dissolving a charge transporting material and an appropriate binder in an organic solvent, applying the solution on the charge generating layer by, for example, dip coating, and drying.

Examples of the charge transporting materials for use in the charge transporting layer include polycyclic aromatic compounds such as anthracene and pyrene; nitrogen-containing heterocyclic compounds such as carbazole and imidazole; hydrazone derivatives; stilbene derivatives; triphenylamine derivatives; and tetraphenylbenzidine derivatives. Examples of the binder include polyester, polycarbonate and polymethyl methacrylate.

The content of the charge transporting material is generally from 1 to 99% by weight, preferably from 10 to 90% by weight based on the weight of the charge transporting layer.

The thickness of the charge transporting layer can be arbitrarily selected from the range of from 5 to 40 μm. Particularly preferred thickness thereof is from 15 to 30 μm.

The invention will be described in more detail below with reference to Synthesis Examples and Examples, but the invention should not be construed as being limited thereto. All the parts are by weight, unless otherwise indicated.

SYNTHESIS EXAMPLE 1

Synthesis of Compound (1)

In 30 ml of dichloromethane were dissolved 3.00 g (38 mmol) of pyridine, 5.00 g (38 mmol) of 2-hydroxyethyl methacrylate and 30 mg of hydroquinone. While stirring the solution under cooling with ice at 5° C., 9.00 g (33 mmol) of anthraquinone-2-carboxylic acid chloride was added thereto in small portions at 5° to 15° C. in a nitrogen atmosphere. After the addition, the mixture was allowed to react at room temperature for 4 hours. The reaction mixture was concentrated under reduced pressure, and the residue was purified by column chromatography on silica gel using ethyl acetate as an eluent to obtain 6.23 g of compound (1).

Melting point: 128°–130° C.

IR Spectrum (KBr method, $cm^{-1}$): 3452, 2956, 1736, 1720, 1684, 1636.

$^1$H-NMR Spectrum ($CDCl_3$, 300 MHz, ppm): 8.8–7.1 (m, 7H), 6.1 (s, 1H), 5.4 (s, 1H), 4.3–4.5 (m, 4H), 1.9 (s, 3H).

SYNTHESIS EXAMPLE 2

Synthesis of Compound (14)

In 70 ml of methylene chloride were dissolved 7.7 ml (0.063 mol) of 2-hydroxyethyl acrylate, 0.08 g of hydroquinone and 10 ml (0.12 mol) of pyridine. A solution of 17.0 g (0.070 mol) of 9-fluorenone-4-carboxylic acid chloride in 250 ml of methylene chloride was added thereto dropwise over a period of about 1 hour while cooling with ice at about 5° C. and stirring. After continuing the stirring for 2 hours at about 5° C., the reaction mixture was diluted with 700 ml of hexane and purified by column chromatography on silica gel using methylene chloride/hexane (1/3 to 1/2 by volume) as an eluent to remove impurity. The eluate was concentrated under reduced pressure, and the precipitated greenish yellow crystals were collected by filtration and dried under reduced pressure to obtain 15.2 g (67%) of compound (14).

Melting point: 105°–106° C.

IR Spectrum (KBr method, $cm^{-1}$): 3430, 2960, 1720.

NMR Spectrum ($CDCl_3$, 300 MHz, ppm): 8.3 (d, 1H), 7.95 (d, 1H), 7.85 (d, 1H), 7.7 (d, 1H), 7.5 (t, 1H), 7.35 (t, 2H), 6.45 (d, 1H), 6.2 (q, 1H), 5.9 (d, 1H).

SYNTHESIS EXAMPLE 3

Synthesis of Compound (15)

In 20 ml of methylene chloride were dissolved 2.07 g (0.011 mol) of 2-hydroxy-9-fluorenone, 0.01 g of hydroquinone and 1.7 ml (0.02 mol) of pyridine. A solution of 1.55 ml (0.016 mol) of methacrylic acid chloride in 10 ml of methylene chloride was added thereto dropwise over a period of about 10 minutes while stirring and cooling with ice at about 5° C. After continuing the stirring for 1 hour at about 5° C., the reaction mixture was diluted with 150 ml of hexane and purified by column chromatography on silica gel using a methylene chloride/hexane mixture (1/4 volume) as an eluent to remove impurity. The eluate was concentrated under reduced pressure, and the precipitated yellow crystals were collected by filtration and dried under reduced pressure to obtain 2.6 g (93%) of compound (15).

Melting point: 130°–133° C.

IR Spectrum (KBr method, $cm^{-1}$): 3450, 2920, 1732, 1716.

NMR Spectrum ($CDCl_3$, 300 MHz, ppm): 7.2–7.7 (m, 7H), 6.4 (s, 1H), 5.8 (s, 1H), 2.1 (s, 3H).

SYNTHESIS EXAMPLE 4

Synthesis of Compound (13)

In 60 ml of methylene chloride were dissolved 7.7 ml (0.063 mol) of 2-hydroxyethyl methacrylate, 0.1 g of hydroquinone and 10 ml (0.12 mol) of pyridine. A solution of 14.5 g (0.060 mol) of 9-fluorenone-4-carboxylic acid chloride in 240 ml of methylene chloride was added thereto dropwise over a period of about 2 hours while stirring and cooling with ice at about 5° C. After continuing the stirring for 2 hours at about 5° C., the reaction mixture was diluted with 700 ml of hexane and purified by column chromatography on silica gel using methylene chloride/hexane (1/3 to 1/2 by volume) as an eluent to remove impurity. The eluate was concentrated under reduced pressure, and the precipitated greenish yellow crystals were collected by filtration and dried under reduced pressure to obtain 10.5 g (52%) of compound (13).

Melting point: 127°–128° C.

IR Spectrum (KBr method, $cm^{-1}$): 3440, 2968, 1724.

NMR Spectrum ($CDCl_3$, 300 MHz, ppm): 8.3 (d, 1H), 7.95 (d, 1H), 7.85 (d, 1H), 7.7 (d, 1H), 7.5 (t, 1H), 7.35 (t, 2H), 6.15 (s, 1H), 5.6 (s, 1H), 4.7 (t, 2H), 4.55 (t, 2H), 1.95 (s, 3H).

SYNTHESIS EXAMPLE 5

Synthesis of Compound (25)

In 30 ml of dichloromethane were dissolved 2.37 g (30 mmol) of pyridine, 4.20 g (32 mmol) of 2-hydroxyethyl methacrylate and 30 mg of hydroquinone. While stirring the solution under ice-cooling at 5° C., a solution of 7.30 g (30 mmol) of benzophenone-4-carboxylic acid chloride in 20 ml of dichloromethane was added thereto dropwise at 5° to 15° C. in a nitrogen stream. After the addition, the mixture was allowed to react at room temperature for 4 hours. The precipitated crystals were separated by filtration with suction, and the filtrate was washed with a saturated sodium chloride aqueous solution and dried over anhydrous sodium sulfate. Dichloromethane was recovered under reduced pressure to obtain white crystals. The crystals were purified by silica gel column chromatography using n-hexane/ethyl acetate to obtain 6.06 g of compound (25).

Melting point: 50°–52° C.

IR Spectrum (KBr method, $cm^{-1}$): 3432, 2956, 1720, 1656.

$^1$H-NMR Spectrum ($CDCl_3$, 300 MHz, ppm): 8.2–7.5 (m, 9H), 6.2 (s, 1H), 5.6 (s, 1H), 4.7–4.5 (m, 4H), 1.9 (s, 3H)

SYNTHESIS EXAMPLE 6

Synthesis of Compound (19)

In 100 ml of dichloromethane were dissolved 60 ml (1.1 mol) of ethylene glycol and 10 ml (0.12 mol) of pyridine. While stirring the solution under ice-cooling at about 5° C., a solution of 14.6 g of 9-fluorenone-4-carboxylic acid chloride in 250 ml of dichloromethane was added thereto dropwise over a period of about 1 hour, followed by stirring at about 5° C. for 30 minutes and then at room temperature for 30 minutes. The reaction mixture was diluted with 300 ml of dichloromethane, washed successively with 500 ml of a 5% aqueous solution of potassium carbonate, 500 ml of 1N hydrochloric acid, 500 ml of 0.1N hydrochloric acid and 500 ml of a 1% aqueous solution of potassium carbonate, and dried over anhydrous sodium sulfate. The reaction mixture was purified by silica gel column chromatography using dichloromethane/ethyl acetate (10/1 by volume) to remove impurity. The eluate was concentrated under reduced pressure, and 500 ml of hexane was added to the residue. The precipitated crystals were collected by filtration and dried under reduced pressure to obtain 14.4 g (89%) of 2-hydroxyethyl 9-fluorenone-4-carboxylate.

Melting point: 130°–132° C.

IR Spectrum (KBr method, $cm^{-1}$): 3320, 2928, 1730, 1712.

$^1$H-NMR Spectrum ($CDCl_3$, 300 MHz, ppm): 8.2 (d, 1H), 7.9 (d, 1H), 7.8 (d, 1H), 7.7 (d, 1H), 7.5 (t, 1H), 7.3 (m, 2H), 4.7 (t, 2H), 4.55 (t, 2H), 4.05 (t, 2H), 2.3 (s, 1H).

In 300 ml of toluene were dissolved 13.4 g (0.05 mol) of the 2-hydroxyethyl 9-fluorenone-4-carboxylate prepared above, 4.0 g (0.06 mol) of malonitrile and 0.5 ml of piperidine, and the solution was stirred under reflux (at about 110° C.) for 5 hours. After allowing to cool, the insoluble matter was filtered and extracted with dichloromethane. The filtrate and extract were concentrated under reduced pressure, and 100 ml of hexane was added thereto. The resulting precipitated crystals were collected by filtration and dried under reduced pressure to obtain 8.3 g (53%) of 2-hydroxyethyl 9-malonilidenefluorene-4-carboxylate as orange crystals.

Melting point: 146°–148° C.

IR Spectrum (KBr method, $cm^{-1}$): 3400, 2952, 2224, 1728.

NMR Spectrum ($CDCl_3$, 300 MHz, ppm): 8.55 (d, 1H), 8.4 (d, 1H), 8.2 (d, 1H), 7.9 (d, 1H), 7.5 (t, 1H), 7.35 (m, 2H), 4.6 (t, 2H), 4.0 (t, 2H), 2.0 (s, 1H)

In 250 ml of dichloromethane were dissolved 5.4 g (0.017 mol) of the 2-hydroxyethyl 9-malonildenefluorene-4-carboxylate prepared above, 0.05 g of hydroquinone and 4 ml (0.05 mol) of pyridine. While stirring and ice-cooling the solution at about 5° C., a solution of 2.2 ml (0.023 mol) of methacrylic acid chloride in 20 ml of dichloromethane was added thereto dropwise over about 10 minutes. After stirring at about 5° C. for 1 hour, the reaction mixture was diluted with 1 l of hexane. The resulting solution was purified by silica gel column chromatography using dichloromethane/hexane mixture (1/2 by volume) to remove impurity. The resulting orange crystals were collected by filtration and dried under reduced pressure to obtain 4.5 g (68%) of compound (19).

Melting point: 124°–126° C.

IR Spectrum (KBr method, $cm^{-1}$): 3440, 2960, 2224, 1724.

$^1$H-NMR Spectrum ($CDCl_3$, 300 MHz, ppm): 8.6 (d, 1H), 8.45 (d, 1H), 8.2 (d, 1H), 7.9 (d, 1H), 7.5 (t, 1H), 7.4 (m, 2H), 6.15 (s, 1H), 5.6 (d, 1H), 4.7 (t, 2H), 4.55 (t, 2H), 1.55 (s, 3H).

SYNTHESIS EXAMPLE 7

Synthesis of Compound (24)

In 100 ml of dichloromethane were dissolved 60 ml of 1,8-octanediol and 10 ml (0.12 mol) of pyridine. While stirring the solution under ice-cooling at about 5° C., a solution of 14.6 g of 9-fluorenone-4-carboxylic acid chloride in 250 ml of dichloromethane was added thereto dropwise over a period of about 1 hour, followed by stirring at about 5° C. for 30 minutes and then at room temperature for 30 minutes. The reaction mixture was diluted with 300 ml of dichloromethane, washed successively with 500 ml of a 5% aqueous solution of potassium carbonate, 500 ml of 1N hydrochloric acid, 500 ml of 0.1N hydrochloric acid and 500 ml of a 1% aqueous solution of potassium carbonate, and dried over anhydrous sodium sulfate. The reaction mixture was purified by silica gel column chromatography using dichloromethane/ethyl acetate (10/1 by volume) to remove impurity. The eluate was concentrated under reduced pressure, and 500 ml of hexane was added to the residue. The resulting precipitated crystals were collected by filtration and dried under reduced pressure to obtain 18.4 g of 2-hydroxyoctyl 9-fluorenone-4-carboxylate.

In 300 ml of toluene were dissolved 13.4 g (0.05 mol) of the 2-hydroxyoctyl 9-fluorenone-4-carboxylate prepared above, 4.0 g (0.06 mol) of malonitrile and 0.5 ml of piperidine, and the solution was stirred under reflux (at about 110° C.) for 5 hours. After allowing to cool, the insoluble matter was filtered and extracted with dichloromethane. The filtrate and extract were concentrated under reduced pressure, and 100 ml of hexane was added thereto. The resulting precipitated crystals were collected by filtration and dried under reduced pressure to obtain 8.3 g of 2-hydroxyoctyl 9-dicyanomethylidenefluorene-4-carboxylate.

The thus obtained 2-hydroxyoctyl 9-dicyanomethylidenefluorene-4-carboxylate (7.0 g, 0.026 mol) was hydrolyzed in 200 ml of ethanol containing 20% hydrogen chloride while heating under reflux for 10 hours. After completion of the reaction, the solvent was evaporated under reduced pressure to afford 6.0 g of 2-hydroxyethyl 9-di(ethoxycarbonyl)methylidenefluorene-4-carboxylate.

In 250 ml of dichloromethane were dissolved 5.0 g of the resulting 2-hydroxyethyl 9-di(ethoxycarbonyl)methylidene-fluorene-4-carboxylate, 0.05 g of hydroquinone and 4 ml (0.05 mol) of piperidine. While stirring the solution at about 5° C. under ice-cooling, a solution of 2.2 ml (0.023 mol) of methacrylic acid chloride in 20 ml of dichloromethane was added thereto dropwise over about 10 minutes. After continuing stirring at about 5° C. for an additional 1 hour period, the reaction mixture was diluted with 1 l of hexane. The solution was purified by column chromatography on silica gel using dichloromethane/hexane (1/2 by volume) to remove impurity. The resulting orange crystals were collected by filtration and dried under reduced pressure to yield 4.5 g of compound (24).

SYNTHESIS EXAMPLE 8

Synthesis of Compound (38)

In 200 ml of dichloromethane were dissolved 19.1 g (0.1 mol) of N-hydroxyethylphthalimide, 0.1 g of hydroquinone and 16 ml (0.2 mol) of pyridine. While stirring the solution at about 5° C. under ice-cooling, a solution of 14.5 ml (0.15 mol) of methacrylic acid chloride in 30 ml of dichloromethane was added thereto dropwise over about 1 hour. After continuing stirring at about 5° C. for an additional 1 hour period, the reaction mixture was washed successively with 1 l of 0.1N hydrochloric acid, 1 l of a 5% aqueous solution of potassium carbonate, and water, followed by drying over anhydrous sodium sulfate. The solution was purified by column chromatography on silica gel using dichloromethane as an eluent to remove impurity. To the eluate was added 500 ml of hexane, followed by concentration under reduced pressure. The resulting precipitated crystals were collected by filtration and dried under reduced pressure to yield 17.0 g (50%) of compound (38).

Melting point: 104°–106° C.

IR Spectrum (KBr method, $cm^{-1}$): 3960, 2960, 1778, 1712.

NMR Spectrum ($CDCl_3$, C, 300 MHz, ppm): 8.6 (d, 2H), 8.2 (d, 2H), 7.75 (t, 2H), 6.1 (s, 1H), 5.5 (s, 1H), 4.35 (t, 2H), 4.3 (t, 2H), 1.9 (s, 3H).

SYNTHESIS EXAMPLE 9

Synthesis of Compound (39)

In 112 ml of dichloromethane were dissolved 13.9 g (68 mmol) of N-(3-hydroxypropyl)phthalimide, 0.1 g of hydroquinone, and 7.11 ml (90 mmol) of pyridine. While stirring the solution at about 5° C. under ice-cooling, a solution of 9.4 g (90 mmol) of methacryl chloride in 20 ml of dichloromethane was added thereto dropwise over about 15 minutes. After continuing stirring at about 5° to 15° C. for an additional 3 hour period, the reaction mixture was washed successively with 1 l of 0.1N hydrochloric acid, 1 l of a 5% aqueous solution of potassium carbonate, and water, followed by drying over anhydrous sodium sulfate. The solution was purified by column chromatography on silica gel using hexane as an eluent to remove impurity. The eluate was concentrated under reduced pressure, and the precipitated crystals were collected by filtration and dried under reduced pressure to obtain 9.58 g (52%) of compound (39).

Melting point: 104°–106° C.

IR Spectrum (KBr method, $cm^{-1}$): 3100, 2984, 2960, 1770, 1720

NMR Spectrum ($CDCl_3$, C, 300 MHz, ppm): 7.8 (d, 2H), 7.7 (d, 2H), 6.1 (s, 1H), 5.5 (s, 1H), 4.35 (t, 2H), 4.3 (t, 2H), 2.1 (m, 2H), 1.9 (s, 3H).

SYNTHESIS EXAMPLE 10

Synthesis of Compound (42)

In 100 ml of dichloromethane were dissolved 4.50 g (35 mmol) of 2-hydroxyethyl methacrylate, 2.37 g (30 mmol) of pyridine and 30 mg of hydroquinone. While stirring the solution at about 5° C. under ice-cooling, 9.00 g (30 mmol) of N-(4-chlorocarboxyphenyl)phthalimide was added thereto in small portions at 5° to 15° C. in a nitrogen atmosphere. After the addition, the mixture was allowed to react at room temperature for 4 hours. The resulting precipitated crystals were collected by filtration with suction, and the filtrate was washed with a saturated sodium chloride aqueous solution, and dried over anhydrous sodium sulfate. The solvent was removed under reduced pressure, and the resulting white crystals were recrystallized from acetone to obtain 6.63 g (52.8%) of compound (42).

Melting point: 143°–146° C.

IR Spectrum (KBr method, $cm^{-1}$): 3082, 2968, 1714, 1638.

$^1$H-NMR Spectrum ($CDCl_3$, C, 300 MHz, ppm): 8.2–7.6 (8H), 6.2 (s, 1H), 5.6 (s, 1H), 4.7–4.5 (4H), 1.9 (s, 3H)

SYNTHESIS EXAMPLE 11

Synthesis of Compound (51)

In 200 ml of dichloromethane were dissolved 20.0 g (0.078 mol) of N-(3'-hydroxypropyl)-1,8-naphthalimide, 0.1 g of hydroquinone and 9.5 ml (0.12 mol) of pyridine. While stirring the solution at about 5° C. with ice-cooling, a solution of 9.0 ml (0.093 mol) of methacrylic acid chloride in 20 ml of dichloromethane was added thereto dropwise over about 30 minutes. The stirring was continued at about 5° C. for an additional 1 hour period, the reaction mixture was washed successively with 500 ml of 0.1N hydrochloric acid, 500 ml of a 5% potassium carbonate aqueous solution, and water, and dried over anhydrous sodium sulfate. The solution was purified by column chromatography on silica gel using dichloromethane as an eluent to remove impurity. To the eluate was added 400 ml of hexane, followed by concentration under reduced pressure. The resulting precipitated crystals were collected by filtration and dried under reduced pressure to obtain 13.9 g (55%) of compound (51).

Melting point: 117°–118° C.

IR Spectrum (KBr method, $cm^{-1}$): 3450, 2964, 1712, 1668.

$^1$H-NMR Spectrum ($CDCl_3$, C, 300 MHz, ppm): 7.85 (q, 2H), 7.7 (q, 2H), 6.05 (s, 1H), 5.55 (s, 1H), 4.4 (s, 2H), 4.0 (t, 2H), 1.9 (s, 3H).

In Synthesis Examples 12 to 24, preparation of polymer A (polymer compound) will be described.

SYNTHESIS EXAMPLE 12

In 6.00 g of tetrahydrofuran (THF) was dissolved 1.00 g of compound (1) obtained in Synthesis Example 1. After purging with nitrogen, 5.00 mg of azobisisobutyronitrile (AIBN) was added to the solution, and the mixture was allowed to react at 60° C. for 48 hours. After the polymerization reaction, the reaction mixture was poured into 200 ml of methanol. The resulting precipitated solid was collected by filtration, dried, and re-dissolved in 20 ml of THF. The solution was again poured into 200 ml of methanol, and the thus precipitated solid was collected by filtration and dried under reduced pressure to obtain 0.98 g of a polymer compound. The resulting polymer compound had a weight average molecular weight of 105000 as measured by gel-permeation chromatography (GPC) using a THF mobile layer.

SYNTHESIS EXAMPLE 13

In 6.00 g of N,N-dimethylacetamide was dissolved 1.00 g of compound (19) obtained in Synthesis Example 6. After purging with nitrogen, 5.00 mg of AIBN was added to the solution, and the mixture was allowed to react at 60° C. for 48 hours. After the polymerization reaction, the reaction mixture was poured into 200 ml of methanol. The resulting precipitated solid was collected by filtration, dried, and re-dissolved in 20 ml of chloroform. The solution was again poured into 200 ml of methanol, and the thus precipitated solid was collected by filtration and dried under reduced pressure to obtain 0.98 g of a polymer compound. The resulting polymer compound had a weight average molecular weight of 124000 as measured by GPC using a chloroform mobile layer.

SYNTHESIS EXAMPLE 14

In 6.00 g of THF were dissolved 1.00 g of compound (1) obtained in Synthesis Example 1 and 1.00 g of methyl methacrylate. After purging with nitrogen, 5.00 mg of AIBN was added to the solution, and the mixture was allowed to react at 60° C. for 48 hours. After the polymerization reaction, the reaction mixture was poured into 200 ml of methanol. The resulting precipitated solid was collected by filtration, dried, and re-dissolved in 20.00 g of THF. The solution was again poured into 200 ml of methanol, and the thus precipitated solid was collected by filtration and dried under reduced pressure to obtain 0.98 g of a polymer compound. The resulting polymer compound had a weight average molecular weight of 155000 as measured by GPC using a THF mobile layer.

SYNTHESIS EXAMPLE 15

In 25 ml of THF were dissolved 2.00 g of compound (14) obtained in Synthesis Example 2 and 2.00 g of 2-hydroxyethyl methacrylate. After purging with nitrogen, 20.00 mg of AIBN was added to the solution, and the mixture was allowed to react at 60° C. for 48 hours. After the polymerization reaction, the reaction mixture was poured into 200 ml of methanol. The resulting precipitated solid was collected by filtration, dried, and re-dissolved in 20.00 g of THF. The solution was again poured into 200 ml of methanol, and the thus precipitated solid was collected by filtration and dried under reduced pressure to obtain 3.98 g of a polymer compound. The resulting polymer compound had a weight average molecular weight of 150000 as measured by GPC using a chloroform mobile layer.

SYNTHESIS EXAMPLE 16

In 4.00 g of N,N-dimethylacetamide was dissolved 1.00 g of compound (38) obtained in Synthesis Example 8. After purging with nitrogen, 5.0 mg of AIBN was added to the solution, and the mixture was allowed to react at 60° C. for 48 hours. After the polymerization reaction, the reaction mixture was poured into 200 ml of methanol. The resulting precipitated solid was collected by filtration, dried, and re-dissolved in 30 ml of dichloromethane. The solution was poured into 300 ml of ethyl acetate, and the thus precipitated solid was collected by filtration and dried under reduced pressure to obtain 0.86 g of a polymer compound. The resulting polymer compound had a weight average molecular weight of 25000 as measured by GPC using a chloroform mobile layer.

SYNTHESIS EXAMPLE 17

In 4.00 g of THF was dissolved 1.00 g of compound (39) obtained in Synthesis Example 9. After purging with nitrogen, 2.0 mg of AIBN was added to the solution, and the mixture was allowed to react at 60° C. for 48 hours. After the polymerization reaction, the reaction mixture was poured into 200 ml of methanol. The resulting precipitated solid was collected by filtration, dried, and re-dissolved in 20 ml of THF. The solution was again poured into 200 ml of methanol, and the thus precipitated solid was collected by filtration and dried under reduced pressure to obtain 0.61 g of a polymer compound. The resulting polymer compound had a weight average molecular weight of 66000 as measured by GPC using a chloroform mobile layer.

SYNTHESIS EXAMPLE 18

In 4.00 g of N,N-dimethylacetamide was dissolved 1.00 g of compound (42) obtained in Synthesis Example 10. After purging with nitrogen, 1.5 mg of AIBN was added to the solution, and the mixture was allowed to react at 60° C. for 48 hours. After the polymerization reaction, the reaction mixture was poured into 200 ml of methanol. The resulting precipitated solid was collected by filtration, dried, and re-dissolved in 30 ml of dichloromethane. The solution was poured into 200 ml of toluene, and the thus precipitated solid was collected by filtration and dried under reduced pressure to obtain 0.81 g of a polymer compound. The resulting polymer compound had a weight average molecular weight of 42000 as measured by GPC using a chloroform mobile layer.

SYNTHESIS EXAMPLE 19

In 6.00 g of N,N-dimethylacetamide was dissolved 1.00 g of compound (51) obtained in Synthesis Example 11. After purging with nitrogen, 1.5 mg of AIBN was added to the solution, and the mixture was allowed to react at 60° C. for 48 hours. After the polymerization reaction, the reaction mixture was poured into 200 ml of methanol. The resulting precipitated solid was collected by filtration, dried, and re-dissolved in 30 ml of dichloromethane. The solution was poured into 200 ml of toluene, and the thus precipitated solid was collected by filtration and dried under reduced pressure to obtain 0.88 g of a polymer compound. The resulting polymer compound had a weight average molecular weight of 34000 as measured by GPC using a chloroform mobile layer.

SYNTHESIS EXAMPLE 20

In 9.00 g of THF was dissolved 3.00 g of compound (1) obtained in Synthesis Example 1. After purging with nitrogen, 12.00 mg of AIBN was added to the solution, and the mixture was allowed to react at 60° C. for 48 hours. After the polymerization reaction, the reaction mixture was poured into 200 ml of methanol. The resulting precipitated solid was collected by filtration, dried, and re-dissolved in 20 ml of THF. The solution was again poured into 200 ml of methanol, and the thus precipitated solid was collected by filtration and dried under reduced pressure to obtain 2.9 g of a polymer compound. The resulting polymer compound had a weight average molecular weight of 225000 as measured by GPC using a chloroform mobile layer.

SYNTHESIS EXAMPLE 21

In 6.00 g of N,N-dimethylacetamide was dissolved 3.00 g of compound (19) obtained in Synthesis Example 6. After purging with nitrogen, 12.00 mg of AIBN was added to the solution, and the mixture was allowed to react at 60° C. for 48 hours. After the polymerization reaction, the reaction mixture was poured into 200 ml of methanol. The resulting precipitated solid was collected by filtration, dried, and re-dissolved in 20 ml of chloroform. The solution was again poured into 200 ml of methanol, and the thus precipitated solid was collected by filtration and dried under reduced pressure to obtain 2.93 g of a polymer compound. The resulting polymer compound had a weight average molecular weight of 553000 as measured by GPC using a chloroform mobile layer.

SYNTHESIS EXAMPLE 22

In 15.00 g of THF were dissolved 2.00 g of compound (14) obtained in Synthesis Example 2 and 2.00 g of 2-hydroxyethyl methacrylate. After purging with nitrogen, 15 mg of AIBN was added to the solution, and the mixture was allowed to react at 60° C. for 48 hours. After the polymerization reaction, the reaction mixture was poured into 200 ml of methanol. The resulting precipitated solid was collected by filtration, dried, and re-dissolved in 20 ml of THF. The solution was again poured into 200 ml of methanol, and the thus precipitated solid was collected by filtration and dried under reduced pressure to obtain 3.98 g of a polymer compound. The resulting polymer compound had a weight average molecular weight of 230000 as measured by GPC using a chloroform mobile layer.

SYNTHESIS EXAMPLE 23

In 15.00 g of N-methylpiperidine (NMP) were dissolved 2.00 g of compound (24) obtained in Synthesis Example 7 and 2.00 g of 2-hydroxyethyl methacrylate. After purging with nitrogen, 15.00 mg of AIBN was added to the solution, and the mixture was allowed to react at 60° C. for 48 hours. After the polymerization reaction, the reaction mixture was poured into 200 ml of methanol. The resulting precipitated solid was collected by filtration, dried, and re-dissolved in 20.00 g of NMP. The solution was again poured into 200 ml of methanol, and the thus precipitated solid was collected by filtration and dried under reduced pressure to obtain 3.98 g of a polymer compound. The resulting polymer compound had a weight average molecular weight of 210000 as measured by GPC using a chloroform mobile layer.

SYNTHESIS EXAMPLE 24

In 15.00 g of THF were dissolved 2.00 g of compound (25) obtained in Synthesis Example 5 and 2.00 g of 2-hydroxyethyl methacrylate. After purging with nitrogen, 15.00 mg of AIBN was added to the solution, and the mixture was allowed to react at 60° C. for 48 hours. After the polymerization reaction, the reaction mixture was poured into 200 ml of methanol. The resulting precipitated solid was collected by filtration, dried, and re-dissolved in 20.00 g of THF. The solution was again poured into 200 ml of methanol, and the thus precipitated solid was collected by filtration and dried under reduced pressure to obtain 3.98 g of a polymer compound. The resulting polymer compound had a weight average molecular weight of 230000 as measured by GPC using a chloroform mobile layer.

EXAMPLE 1

In 50 ml of dichloromethane were dissolved 2.00 g of the polymer compound obtained in Synthesis Example 12 and 1.00 g of 3-methacryloxypropyltrimethoxysilane, and the resulting solution was applied to an aluminum pipe having a diameter of 40 mm and a length of 318 mm by dip coating and dried at 150° C. for 30 minutes to form an undercoat layer having a thickness of 1.0 μm.

One part of an X-form metal-free phthalocyanine pigment, 1 part of a vinyl chloride-vinyl acetate copolymer (VMCH, produced by Union Carbide Corp.), and 40 parts of n-butyl acetate were dispersed together with glass beads of 1 mm in diameter in a sand mill for 2 hours. The resulting dispersion was applied to the undercoat layer by dip coating and dried at 100° C. for 10 minutes to form a charge generating layer having a thickness of 0.2 μm.

In 6 parts of monochlorobenzene were dissolved 1 part of N,N'-diphenyl-N,N'-bis(3-methylphenyl)benzidine and 1 part of poly(4,4-cyclohexylidenephenylenecarbonate), and the solution was applied to the charge generating layer by dip coating and dried at 135° C. for 1 hour to form a charge transporting layer having a thickness of 20 μm to prepare an electrophotographic photoreceptor.

EXAMPLE 2

An electrophotographic photoreceptor was prepared in the same manner as in Example 1, except that the polymer compound obtained in Synthesis Example 12 used in Example 1 was replaced with the polymer compound obtained in Synthesis Example 13.

EXAMPLE 3

An electrophotographic photoreceptor was prepared in the same manner as in Example 1, except that the silane compound used in Example 1 was omitted and that the X-form metal-free phthalocyanine used in Example 1 was replaced with α-form titanyl phthalocyanine.

EXAMPLE 4

An electrophotographic photoreceptor was prepared in the same manner as in Example 1, except that the silane compound used in Example 1 was omitted and that the polymer compound obtained in Synthesis Example 12 and the X-form metal-free phthalocyanine each used in Example 1 were replaced, respectively, with the polymer compound obtained in Synthesis Example 14 and chlorogallium phthalocyanine crystals prepared according to the method described in JP-A-5-194523.

EXAMPLE 5

In 50 ml of 1,1,2,2-tetrachloroethane were dissolved 2.00 g of the polymer compound obtained in Synthesis Example 16 and 1.00 g of 3-methacryloxypropyltrimethoxysilane, and the resulting solution was applied to an aluminum pipe having a diameter of 40 mm and a length of 318 mm by dip coating and dried at 150° C. for 30 minutes to form an undercoat layer having a thickness of 1.0 μm.

One part of an X-form metal-free phthalocyanine pigment, 1 part of a vinyl chloride-vinyl acetate copolymer (VMCH, produced by Union Carbide Corp.) and 40 parts of n-butyl acetate were dispersed together with glass beads of 1 mm in diameter in a sand mill for 2 hours. The resulting dispersion was applied to the undercoat layer by dip coating and dried at 100° C. for 10 minutes to form a charge generating layer having a thickness of 0.2 μm.

In 6 parts of monochlorobenzene were dissolved 1 part of N,N'-diphenyl-N,N'-bis(3-methylphenyl)benzidine and 1 part of poly(4,4-cyclohexylidenediphenylenecarbonate), and the solution was applied to the charge generating layer by dip coating and dried at 135° C. for 1 hour to form a charge transporting layer having a thickness of 20 μm to prepare an electrophotographic photoreceptor.

EXAMPLE 6

An electrophotographic photoreceptor was prepared in the same manner as in Example 5, except that the silane compound used in Example 5 was omitted and that the polymer compound obtained in Synthesis Example 16 used in Example 5 was replaced with the polymer compound obtained in Synthesis Example 17.

EXAMPLE 7

An electrophotographic photoreceptor was prepared in the same manner as in Example 5, except that the silane compound used in Example 5 was omitted and that the polymer compound obtained in Synthesis Example 16 and the X-form metal-free phthalocyanine each used in Example 5 were replaced, respectively, with the polymer compound obtained in Synthesis Example 18 and α-form titanyl phthalocyanine.

EXAMPLE 8

An electrophotographic photoreceptor was prepared in the same manner as in Example 5, except that the silane compound used in Example 5 was omitted and that the polymer compound obtained in Synthesis Example 16 and the X-form metal-free phthalocyanine were replaced, respectively, with the polymer compound obtained in Synthesis Example 19 and hydroxygallium phthalocyanine crystals prepared according to the method described in JP-A-5-279591.

EXAMPLE 9

In 50 ml of dichloromethane were dissolved and dispersed 2.00 g of the polymer compound obtained in Synthesis Example 19 and 0.1 g of n-octyl 9-dicyanomethylenefluorene-4-carboxylate, and 1.00 g of 3-methacryloxypropyltrimethoxysilane and dichloromethane were added thereto, followed by mixing thoroughly. The resulting solution was applied to an aluminum pipe having a diameter of 40 mm and a length of 318 mm by dip coating and dried at 150° C. for 30 minutes to form an undercoat layer having a thickness of 1.0 μm.

One part of an X-form metal-free phthalocyanine pigment, 1 part of a vinyl chloride-vinyl acetate copolymer (VMCH, produced by Union Carbide Corp.), and 40 parts of n-butyl acetate were dispersed together with glass beads of 1 mm in diameter in a sand mill for 2 hours. The resulting dispersion was applied to the undercoat layer by dip coating and dried at 100° C. for 10 minutes to form a charge generating layer having a thickness of 0.2 μm.

In 6 parts of monochlorobenzene were dissolved 1 part of N,N'-diphenyl-N,N'-bis(3-methylphenyl)benzidine and 1 part of poly(4,4-cyclohexylidenephenylenecarbonate), and the solution was applied to the charge generating layer by dip coating and dried at 135° C. for 1 hour to form a charge transporting layer having a thickness of 20 μm to prepare an electrophotographic photoreceptor.

EXAMPLE 10

An electrophotographic photoreceptor was prepared in the same manner as in Example 9, except that the silane compound used in Example 9 was omitted and that 2.00 g of the polymer compound obtained in Synthesis Example 19 and 0.1 g of n-octyl 9-dicyanomethylenefluorene-4-carboxylate each used in Example 9 were replaced, respectively, with 2.00 g of the polymer compound obtained in Synthesis Example 20 and 0.06 g of 9-(4-diethylaminostyryl)anthracene.

EXAMPLE 11

An electrophotographic photoreceptor was prepared in the same manner as in Example 9, except that 2.00 g of the polymer compound obtained in Synthesis Example 19, 0.1 g of n-octyl 9-dicyanomethylenefluorene-4-carboxylate and 3-methacryloxypropyltrimethoxysilane each used in Example 9 were replaced, respectively, with 2.00 g of the polymer compound obtained in Synthesis Example 21, 0.2 g of zirconium acetylacetonate and 0.05 g of 3-aminopropyltrimethoxysilane, and that the X-form metal-free phthalocyanine was replaced with chlorogallium phthalocyanine crystals prepared according to the method described in JP-A-5-194523.

EXAMPLE 12

An electrophotographic photoreceptor was prepared in the same manner as in Example 9, except that 2.00 g of the polymer compound obtained in Synthesis Example 19, 0.1 g of n-octyl 9-dicyanomethylenefluorene-4-carboxylate and 3-methacryloxypropyltrimethoxysilane each used in Example 9 were replaced, respectively, with 2.00 g of the polymer compound obtained in Synthesis Example 24, 0.4 g of 2,5-diethyl-7,7,8,8-tetracyanoquinodimethane and 0.2 g of 3-aminopropyltrimethoxysilane, and that the X-form metal-free phthalocyanine was replaced with chlorogallium phthalocyanine crystals prepared according to the method described in JP-A-5-194523.

COMPARATIVE EXAMPLE 1

An electrophotographic photoreceptor was prepared in the same manner as in Example 1, except that the undercoat layer was formed by applying a solution of 1.5 parts of a polyester resin (Vylon 200, produced by Toyobo Co., Ltd.) and 0.5 part of 2,4,7-trinitrofluorenone in 20 parts of 1,1,2,2-tetrachloroethane onto the aluminum pipe and drying at 150° C. for 10 minutes to have a dry thickness of 1.0 μm.

COMPARATIVE EXAMPLE 2

An electrophotographic photoreceptor was prepared in the same manner as in Example 1, except that the undercoat layer was formed by applying a solution of 1 part of a copolymer nylon resin (Aramine CM8000, produced by Toray Industries, Inc.) in 8 parts of ethanol onto the aluminum pipe and drying at 150° C. for 10 minutes to have a dry thickness of 1.0 μm.

The electrophotographic photoreceptors prepared in Examples 1 to 12 and comparative Examples 1 to 2 were tested on a laser printer (XP-11, manufactured by Fuji Xerox Co., Ltd.) that was modified for evaluation, to evaluate electrical characteristics. Evaluation was made by measuring the surface potential (VH) of the photoreceptor in the case where charging was not followed by irradiation with a laser beam, the surface potential (VL) of the photoreceptor in the case where charging was followed by irradiation with 12 erg/cm$^2$ of a laser beam, and the surface potential (VR) in the case when the photoreceptor was irradiated with light of 30 erg/cm$^2$, each under both of a normal temperature and normal humidity condition (20° C., 40% RH) and a low temperature and low humidity condition (10° C., 20% RH). The results obtained are shown in Table 6 below.

TABLE 6

| | VH (V) | | VL (V) | | VR (V) | |
|---|---|---|---|---|---|---|
| | 20° C., 40% RH | 10° C., 20% RH | 20° C., 40% RH | 10° C., 20% RH | 20° C., 40% RH | 10° C., 20% RH |
| Example 1 | −780 | −790 | −110 | −130 | −30 | −35 |
| Example 2 | −800 | −800 | −90 | −100 | −40 | −45 |
| Example 3 | −800 | −800 | −90 | −100 | −35 | −40 |
| Example 4 | −800 | −800 | −90 | −100 | −40 | −50 |
| Example 5 | −800 | −800 | −110 | −115 | −35 | −40 |
| Example 6 | −790 | −795 | −100 | −110 | −40 | −45 |
| Example 7 | −795 | −800 | −95 | −100 | −35 | −40 |
| Example 8 | −780 | −790 | −60 | −65 | −25 | −30 |
| Example 9 | −780 | −780 | −100 | −110 | −35 | −40 |
| Example 10 | −780 | −770 | −90 | −95 | −30 | −35 |
| Example 11 | −800 | −800 | −90 | −95 | −35 | −40 |
| Example 12 | −800 | −800 | −95 | −100 | −35 | −40 |
| Compara. Example 1 | −800 | −830 | −150 | −300 | −90 | −250 |
| Compara. Example 2 | −800 | −805 | −90 | −150 | −30 | −75 |

As described and demonstrated above, the electrophotographic photoreceptor of the invention having an undercoat layer containing the specific polymer compound has excellent chargeability and exhibits, even under a low temperature and low humidity condition, high photosensitivity and low residual potential, to thereby exhibit stable electrophotographic performance irrespective of the environmental conditions.

While the invention has been described in detail and with reference to specific examples thereof, it will be apparent to one skilled in the art that various changes and modifications can be made therein without departing from the spirit and scope thereof.

What is claimed is:

1. An electrophotographic photoreceptor comprising a conductive substrate having thereon at least an undercoat layer and a photoconductive layer, wherein the photoconductive layer has a laminate structure comprising a charge generating layer and a charge transporting layer, and wherein the undercoat layer comprises a polymer compound prepared by using at least one monomer represented by formula (1):

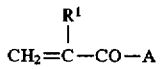

(1)

wherein $R^1$ represents a hydrogen atom or a methyl group; and A represents a group represented by formula (2), (3), (4), (5) or (6):

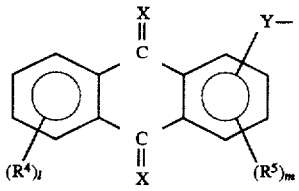

(2)

-continued

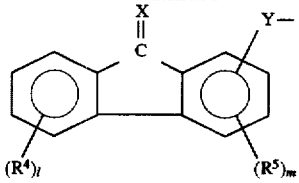

(3)

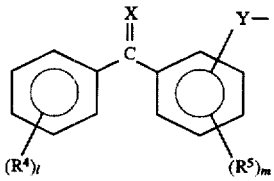

(4)

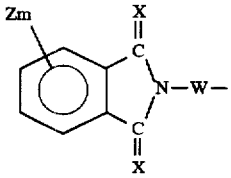

(5)

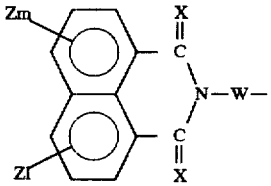

(6)

wherein X represents an oxygen atom, $C(CN)_2$, $C(CN)COOR^2$ or $C(COOR^2)(COOR^3)$; Y represents an oxygen atom or $—COO(CH_2)_nO—$ in formulas (2) and (4), and an oxygen atom in formula (3); $R^2$ and $R^3$ each represent an alkyl group or an aryl group; $R^4$ and $R^5$ each represent an alkyl group, an aryl group, a halogen atom, a nitro group, an acyl group, or a cyano group; W represents $—(CH_2)_nO—$ or $—Ar—(R)_k—COO(CH_2)_nO—$, wherein Ar represents an arylene group, R represents an alkylene group, and k represents 0 or 1; Z represents an alkyl group, an aryl group, a halogen atom, a nitro group, an acyl group, or a cyano group; n represents an integer of 1 to 20; and m and l each represent an integer of 0 to 2.

2. The electrophotographic photoreceptor according to claim 1, wherein the polymer compound is a copolymer comprising the monomer represented by formula (1) and a polymerizable olefinic monomer.

3. The electrophotographic photoreceptor according to claim 2, wherein the polymerizable olefinic monomer is selected from the group consisting of acrylic acid derivatives, acryloxysilanes, and vinyl compounds.

4. The electrophotographic photoreceptor according to claim 1, wherein the undercoat layer further comprises an organic low-molecular weight compound, wherein the organic low-molecular weight compound is an electron-accepting substance selected from the group consisting of aromatic nitro compounds, cyclic carboxylic acid anhydrides, aromatic carboxylic acid imides, quinones, tetracyanoquinodimethane derivatives, and fluorenone derivatives.

5. The electrophotographic photoreceptor according to claim 1, wherein the undercoat layer further comprises an organic low-molecular weight compound, wherein the organic low-molecular weight compound is an electron-donating substance selected from the group consisting of oxadiazoles, styryl compounds, carbazole compounds, pyrazoline compounds, triphenylamine compounds, tetrathiafulvalene, and N,N,N'N'-tetraethylphenylenediamine.

6. The electrophotographic photoreceptor according to claim 1, wherein the undercoat layer further comprises an organic low-molecular weight compound, wherein the organic low-molecular weight compound is an organic metal compound selected from the group consisting of chelate complexes of a transition metal element or group III or VI metallic element, and cyclopentadienyl complexes of these metallic elements.

7. The electrophotographic photoreceptor according to claim 1, wherein the photoconductive layer comprises a phthalocyanine pigment.

* * * * *